US008075215B2

(12) United States Patent
Albisetti

(10) Patent No.: US 8,075,215 B2
(45) Date of Patent: Dec. 13, 2011

(54) DEVICE AND METHOD FOR APPLYING A PRODUCT

(75) Inventor: Nicolas Albisetti, Clichy (FR)

(73) Assignee: L'Oréal S.A., Paris (FR)

( * ) Notice: Subject to any disclaimer, the term of this patent is extended or adjusted under 35 U.S.C. 154(b) by 756 days.

(21) Appl. No.: 11/038,234

(22) Filed: Jan. 21, 2005

(65) Prior Publication Data

US 2005/0169696 A1 Aug. 4, 2005

Related U.S. Application Data

(60) Provisional application No. 60/542,847, filed on Feb. 10, 2004.

(30) Foreign Application Priority Data

Jan. 22, 2004 (FR) ..... 04 50117

(51) Int. Cl.
*A47L 13/22* (2006.01)

(52) U.S. Cl. ..... 401/284; 401/282

(58) Field of Classification Search ..... 401/183–186, 401/263, 268–271, 282, 284, 286
See application file for complete search history.

(56) References Cited

U.S. PATENT DOCUMENTS

| | | | | |
|---|---|---|---|---|
| 64,732 A | | 5/1867 | Wylie | |
| 158,943 A | | 1/1875 | Hussey | |
| 2,253,779 A | * | 8/1941 | Gutierrez | 401/15 |
| 2,891,272 A | * | 6/1959 | Grebner et al. | 401/269 |
| 3,206,789 A | * | 9/1965 | Krauth | 401/183 |
| 3,655,290 A | * | 4/1972 | Griffith | 401/186 |
| 3,739,789 A | | 6/1973 | Cataneo et al. | |
| 3,915,577 A | * | 10/1975 | Cropton | 401/186 |
| 4,040,753 A | * | 8/1977 | Griffith | 401/186 |
| 4,748,990 A | * | 6/1988 | Brown et al. | 132/320 |
| 4,841,996 A | | 6/1989 | Gueret | |
| 4,990,016 A | | 2/1991 | Seidler | |
| 5,339,841 A | | 8/1994 | Gueret | |
| 5,345,981 A | | 9/1994 | Pavenick et al. | |

(Continued)

FOREIGN PATENT DOCUMENTS

DE 31 22 237 A1 1/1983

(Continued)

OTHER PUBLICATIONS

English language Derwent Abstract of DE 31 22 237 A1, Jan. 5, 1983.

(Continued)

*Primary Examiner* — Huyen Le

(74) *Attorney, Agent, or Firm* — Finnegan, Henderson, Farabow, Garrett & Dunner, L.L.P.

(57) ABSTRACT

A device configured to apply a product may include a receptacle defining an inside space configured to contain a product to be applied and an applicator element fixed to the receptacle. The device may include a cap configured to close the receptacle. The device may include at least one channel configured to load the applicator element with product from the receptacle. The at least one channel may be in flow communication with an inside space of the receptacle and the at least one channel may open out directly to an outer periphery of the applicator element. The at least one channel may be disposed so as to be able to guide product from the receptacle over the outer periphery of the applicator element.

73 Claims, 5 Drawing Sheets

U.S. PATENT DOCUMENTS

| | | | | |
|---|---|---|---|---|
| 5,397,195 | A | 3/1995 | Goncalves | |
| 6,536,977 | B1 | 3/2003 | Hammel | |
| 6,969,210 | B1 * | 11/2005 | Newell | 401/284 |

FOREIGN PATENT DOCUMENTS

| | | | |
|---|---|---|---|
| DE | 36 08 955 | A1 | 10/1987 |
| FR | 940 464 | | 12/1948 |
| FR | 2 155 688 | | 5/1973 |
| FR | 2 585 934 | | 2/1987 |
| WO | WO 01/76408 | A1 | 10/2001 |

OTHER PUBLICATIONS

English language Derwent Abstract of DE 36 08 955 A1, Oct. 8, 1987.

* cited by examiner

DEVICE AND METHOD FOR APPLYING A PRODUCT

This application claims the benefit of priority under 35 U.S.C. §119(e) of U.S. Provisional application No. 60/542,847, filed on Feb. 10, 2004, the disclosure of which is incorporated herein by reference.

The present invention relates to devices and methods for applying a substance, for example, a cosmetic product and/or a care product. For example, the devices and methods for applying a substance may be used to apply cosmetic products, care products, make-up products, and/or products such as those defined in Counsel Directive 93/35/EEC (European Economic Community) dated Jun. 14, 1993, modifying EEC Directive 76/768, which provides one non-limiting, exemplary definition of cosmetic products. (Other definitions are also possible.) Cosmetic products include, for example, makeup for the skin, hair, and/or nails, and care products include, for example, those products intended to be applied to the human and/or animal body to treat and/or prevent a pathological condition.

Examples of applicators having an applicator element carried by a closure cap of a receptacle containing the substance to be applied are disclosed for example, in French patent nos. 940 464 and 2 585 934, and in U.S. Pat. No. 5,345,981. Such applicators, however, may be relatively complex to manufacture and/or may not contain sufficient substance for application. Examples of applicators in which the applicator element is secured to the receptacle while in use are disclosed, for example, in U.S. Pat. Nos. 64,732, 158,943, and 4,990,016, and in German patent application no. 3 122 237. In at least some of those examples, the substance is fed directly to the core of the applicator element, which may render it relatively difficult to control the quantity of substance dispensed and/or may render the applicator element complicated to manipulate. German patent application no. 3 608 955 discloses an applicator, including a pusher member rendering it possible for substance feeding to be switched on and off.

There may exist a need to improve applicators having an applicator element that is configured to be fed continuously, thereby enabling substance to be applied, for example, without having to return the applicator element to a receptacle in order to re-load it with substance.

The invention may seek to satisfy the above-mentioned need. Although the present invention may obviate the above-mentioned need, it should be understood that some aspects of the invention might not necessarily obviate the above-mentioned need.

In the following description, certain aspects and embodiments will become evident. It should be understood that the invention, in its broadest sense, could be practiced without having one or more features of these aspects and embodiments. It should be understood that these aspects and embodiments are merely exemplary.

In one aspect, as embodied and broadly described herein, the invention includes a device configured to apply a product. The device may include a receptacle defining an inside space configured to contain the product to be applied. The inside space may define a volume. The device may include an applicator element fixed to the receptacle at least while the applicator element is in use, and the applicator element may define an outer periphery. The device may include a cap configured to close the receptacle, and the cap may define a housing configured to receive the applicator element. The housing may define a volume smaller than the volume of the inside space of the receptacle configured to contain the product to be applied. The device may also include at least one channel configured to load the applicator element with product from the receptacle. The at least one channel may be in flow communication with the inside space of the receptacle when the receptacle is closed by the cap. The at least one channel may open out directly to the outer periphery of the applicator element, and the at least one channel may be disposed so as to be able to guide product from the receptacle over the outer periphery of the applicator element.

As used herein, the term "open out directly" means that the substance can reach the outside of the applicator element without necessarily needing to pass through the applicator element beforehand.

Some embodiments of the invention may allow a user to visually check the quantity of substance that is being delivered to the applicator element while in use and may render it easier to obtain a neat makeup effect. According to some embodiments, the relatively small inside volume of the cap may reduce the risk of some residual quantity of substance that might be present on the applicator element from drying out while the applicator is not in use. For example, when the receptacle is closed by the cap, it may be at least partially full of substance to be applied, such that the applicator element may remain loaded with substance during storage, for example, even if the receptacle is almost empty.

Guiding the substance over the outer periphery of the applicator element may render it easier to mount the applicator element to the receptacle, for example, with an applicator element having a tuft of bristles, such that the tuft may be mounted via stapling it to the bottom of a housing provided on the receptacle.

In another aspect, the receptacle may include the at least one channel.

In yet another aspect, the at least one channel may be configured to guide product from the receptacle into the housing of the cap so that the housing may be at least partially filled with product when the receptacle is closed by the cap. For example, the at least one channel may be configured to permit the product to flow via gravity into the housing of the cap. For example, all of the substance initially contained in the device may be contained in the receptacle, and the wall of the receptacle may be in contact with the substance to be applied. The inside volume of the cap may be too small to receive all of the substance initially contained in the applicator.

According to another aspect, the at least one channel may include a plurality of channels configured to feed the applicator element. For example, the plurality of channels may be evenly distributed angularly around a longitudinal axis of the device.

In yet a further aspect, flow communication with the inside space of the receptacle and the housing of the cap may occur exclusively via the at least one channel.

In still another aspect, the receptacle may define a length at least twice as long as a length defined by the cap. A relatively long receptacle may render it easier for the user to exert pressure on its wall, for example, so as to raise pressure inside the receptacle, thereby tending to force some of the substance through the at least one channel. According to a further aspect, the receptacle may include an applicator element holder, and the at least one channel may be formed in the applicator element holder. In still a further aspect, the receptacle may include a receptacle body and an adaptor mounted to the receptacle body, and the adaptor may be configured to permit the cap to be removably mounted to the receptacle. Such an adaptor may achieve economies of scale, for example, by using a single adaptor for a plurality of different receptacle bodies and/or applicator element holders.

In yet another aspect, the receptacle may include a receptacle body and an adaptor mounted to the receptacle body, and the adaptor may be configured to permit the cap to be removably mounted to the receptacle. For example, the applicator element holder may be fitted onto the adaptor. According to some aspects, the applicator element holder may be formed integrally as a single piece with the adaptor (e.g., the adaptor and applicator element holder may be formed from a molded plastic material).

In still another aspect, the adaptor may be configured to be threaded onto the receptacle body. According to some aspects, the adaptor may be configured to be mounted to the receptacle body via snap-fastening.

In a further aspect, the receptacle body may include a neck and the adaptor may include an annular sealing lip configured to bear in a substantially sealed manner against the neck of the receptacle body. In some aspects, the cap may be configured to be threaded onto the adaptor. For example, the cap may be configured to be threaded onto the adaptor via an internally threaded skirt, which may serve, for example, to reduce the risk of the user soiling their fingers while the cap is being mounted or removed.

In yet another aspect, the cap may bear in a substantially sealed manner against at least one of the applicator element holder and the adaptor. According to some aspects, at least a portion of the cap may be at least partially transparent (e.g., entirely transparent). In some aspects, the cap may be formed of a plastic material and/or glass.

According to a further aspect, the cap may include a body and a plug mounted to the body, and the plug may define at least a portion of a top of the cap. For example, the cap may carry a label and/or a disk indicating the color of and/or a reference for the substance contained in the receptacle.

In another aspect, the plug does not contribute in any way to closing the receptacle. For example, the plug may be engaged on an upwardly closed central portion of the body of the cap.

In still a further aspect, the plug may contribute to closing the receptacle. For example, the body of the cap may include a first skirt and the plug may include a second skirt configured to bear in a substantially sealed manner against the first skirt.

In yet another aspect, the receptacle may include an externally threaded skirt and the cap may include an outer skirt and an inner skirt, and the inner skirt may be connected at one end (e.g., the bottom) to the outer skirt. The outer skirt may be configured to be placed in threaded engagement with the externally threaded skirt of the receptacle, and the cap may further include a body associated with the inner skirt. The body may be configured to bear in a substantially sealed manner against the applicator element holder.

In another aspect, the receptacle may include an internally threaded skirt and the cap may include an inner skirt and an outer skirt connected at one end (e.g., the bottom) to the inner skirt. The inner skirt may be configured to be placed in threaded engagement with the internally threaded skirt of the receptacle (e.g., of the adaptor).

In still another aspect, the cap may include a plurality of parts associated with one another. In some aspects, the cap may include a single piece.

In still a further aspect, the receptacle may include a receptacle body and an adaptor mounted to the receptacle body, and the adaptor may include a transverse wall and may be configured to permit the cap to be removably mounted to the receptacle. The applicator element holder may include a collar configured to abut against the transverse wall of the adaptor.

In still a further aspect, the cap may bear against the collar once tightened onto the adaptor. For example, the collar may contribute to sealing the receptacle when closed, for example, if the collar is formed of a flexible material.

In yet another aspect, the transverse wall may include an annular lip, for example, so as to improve the sealing of the connection between the applicator element holder and the adaptor.

According to yet another aspect, the applicator element holder may include at least one portion in relief (e.g., at least one portion defining an annular bead or an annular recess) configured to be snap-fastened onto the transverse wall.

In yet another aspect, the cap may include a sealing surface configured to bear against the applicator element holder. For example, the sealing surface may include a lip and/or the sealing surface may be substantially conical.

In still another aspect, the applicator element holder may include an annular sealing lip configured to bear against the cap when the cap is mounted to the device. According to some aspects, the applicator element holder may include a skirt partially covering the applicator element. In some aspects, the applicator element holder may define a housing rendering it possible to fix the applicator element onto the applicator element holder. For example, the at least one channel may extend at least partially over an outside surface of the skirt, which may contribute to channeling the substance toward a predetermined zone of the applicator element, which may be useful, for example, when the applicator element defines a particular shape (e.g., a shape that is not a body of revolution).

In still another aspect, the at least one channel may include a plurality of channels, and the applicator element holder may include at least two tabs such that the plurality of channels extend therebetween. For example, the applicator element holder may include at least three tabs and the plurality of channels extend therebetween. The tabs may serve to assist the substance to flow as far as the applicator element via capillary retention between the tabs (e.g., the applicator may be held with the applicator element pointing downward, for example, with its longitudinal axis inclined at about 45° with respect to vertical).

In yet another aspect, the tabs may define outside faces sloping obliquely toward the applicator element. In a further aspect, the tabs may define free ends having surfaces directed toward the applicator element, for example, so that the applicator element may be better fed with substance.

In yet a further aspect, the applicator element holder may include a housing configured to receive the applicator element and the housing of the applicator element holder may include a side wall defining a thickness and an end wall defining a thickness greater than the thickness of the side wall, for example, thereby rendering the applicator element holder able to withstand a staple being fixed therein for holding, for example, a bundle of bristles on the applicator element holder (e.g., when the applicator element includes a brush).

In yet another aspect, the receptacle may include two channels positioned substantially opposite to one another.

In still a further aspect, the applicator element holder may include a portion configured to receive the applicator element and the portion may be added to the applicator element holder.

According to another aspect, the applicator element holder may include internal ribs configured to mount the portion to the applicator element holder.

In yet another aspect, the receptacle may include a tubular wall extending along at least part of the length of the applicator element, and the tubular wall may be configured to distribute product delivered by the at least one channel around the applicator element.

In some aspects, the tubular wall may, for example, extend beyond a part that receives the applicator element and that may be added to the applicator element holder. In some further aspects, the tubular wall may connect at its base to a substantially truncated wall of the applicator element holder.

In still a further aspect, the applicator element may include an end connected to the receptacle and a free end and may define an axis intersecting the end connected to the receptacle and the free end. The at least one channel may extend in a non-perpendicular direction relative to the axis. For example, the at least one channel may extend in a direction substantially parallel to the axis defined by the applicator element.

In yet another aspect, the at least one channel may be configured to direct product from the receptacle toward and over the outer periphery of the applicator element.

In still another aspect, the applicator element may include one of a flocked tip, a foam element, a felt element, bristles, and a flexible point.

In a further aspect, the device may include a product contained in the inside space of the receptacle. For example, the product may be chosen from a cosmetic product and a care product (e.g., the product may include nail varnish).

According to another aspect, a device configured to apply a product may include a receptacle defining an inside space configured to contain the product to be applied. The inside space may define a volume. The device may further include an applicator element fixed to the receptacle at least while the applicator element is in use, and the applicator element may define an outer periphery. The device may include a cap configured to close the receptacle, and the cap may define a housing configured to receive the applicator element. The housing may define a volume smaller than the volume of the inside space of the receptacle. The device may further include at least one channel configured to load the applicator element with product from the receptacle. The at least one channel may be in flow communication with the inside space of the receptacle when the receptacle is closed by the cap, and the at least one channel may open out directly to the outer periphery of the applicator element. The applicator element may include an end connected to the receptacle and a free end and may define an axis intersecting the end connected to the receptacle and the free end. The at least one channel may extend in a non-perpendicular direction relative to the axis.

In yet another aspect, the at least one channel may extend in a direction substantially parallel to the axis defined by the applicator element.

In still a further aspect, the at least one channel may be disposed so as to be able to guide product from the receptacle toward and over the outer periphery of the applicator element.

According to a further aspect, the at least one channel may include a portion having a tubular cross section and a portion having an open-sided cross section.

According to yet another aspect, a method of applying a product may include providing a device including a receptacle defining an inside space containing a product. The device may include an applicator element mounted to the receptacle and defining an outer periphery and a cap defining a housing configured to receive the applicator element when the device is in a storage position. The housing may have a volume smaller than a volume of the inside space. The method may include removing the cap from the receptacle so as to expose the applicator element, flowing product contained in the inside space through a channel opening out directly to the outer periphery of the applicator element such that the channel guides the product toward and over the outer periphery of the applicator element.

In still another aspect, the applicator element may include an end connected to the receptacle and a free end, and may define an axis intersecting the end connected to the receptacle and the free end. Flowing the product may include flowing the product through the at least one channel such that the product exits the channel in a non-perpendicular direction relative to the axis of the applicator element. For example, flowing the product may include flowing the product through the at least one channel such that the product exits the channel in a substantially parallel direction relative to the axis of the applicator element.

In yet a further aspect, the device may include a receptacle defining an inside space configured to contain the product to be applied. The device may include an applicator element fixed to the receptacle at least while the applicator element is in use, and the applicator element may define an outer periphery. The device may include a cap configured to close the receptacle. The device may include at least one channel configured to load the applicator element with product from the receptacle, and the at least one channel may be in flow communication with the inside space of the receptacle. The at least one channel may be configured to guide substance contained in the receptacle over the outer periphery of the applicator element, and the applicator element may be mounted in a housing of an applicator element holder, which may include at least one portion (e.g., a frustoconical portion) that reduces the inside section provided in the applicator element holder for the flow of substance. The reduction in section may be desirable for providing a relatively wide upstream section, may reduce headloss, and/or may encourage flow of substance.

In still another aspect, an applicator may include a receptacle configured to contain a substance to be applied, an applicator element that may be fixed onto the receptacle, at least while in use, and a cap for closing the receptacle. The receptacle may include a plurality of channels (e.g., feed channels) configured to load the applicator element with substance. The channels may be disposed so as to guide the substance contained in the receptacle over the outer periphery of the applicator element.

In a further aspect, an applicator may include a receptacle configured to contain a substance to be applied, an applicator element configured to be mounted to the receptacle, at least while in use, and/or a cap for closing the receptacle. The receptacle may include at least one channel configured to load the applicator element with substance. The channel may be in fluid communication with the inside of the receptacle, and the channel may be disposed so as to guide the substance contained in the receptacle over the outer periphery of the applicator element. The receptacle may include a receptacle body provided with a neck and an adaptor including a mounting skirt to which the neck may be mounted.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of this specification. The drawings illustrate exemplary embodiments of the invention and, together with the description, serve to explain some principles of the invention. In the drawings, FIG. 1 is a schematic, partial section view of an exemplary embodiment of device configured to apply a product;

Reference will now be made in detail to some possible embodiments of the invention, examples of which are illustrated in the accompanying drawings. Wherever possible, the same reference numbers are used in the drawings and the description to refer to the same or like parts.

Figure 1:
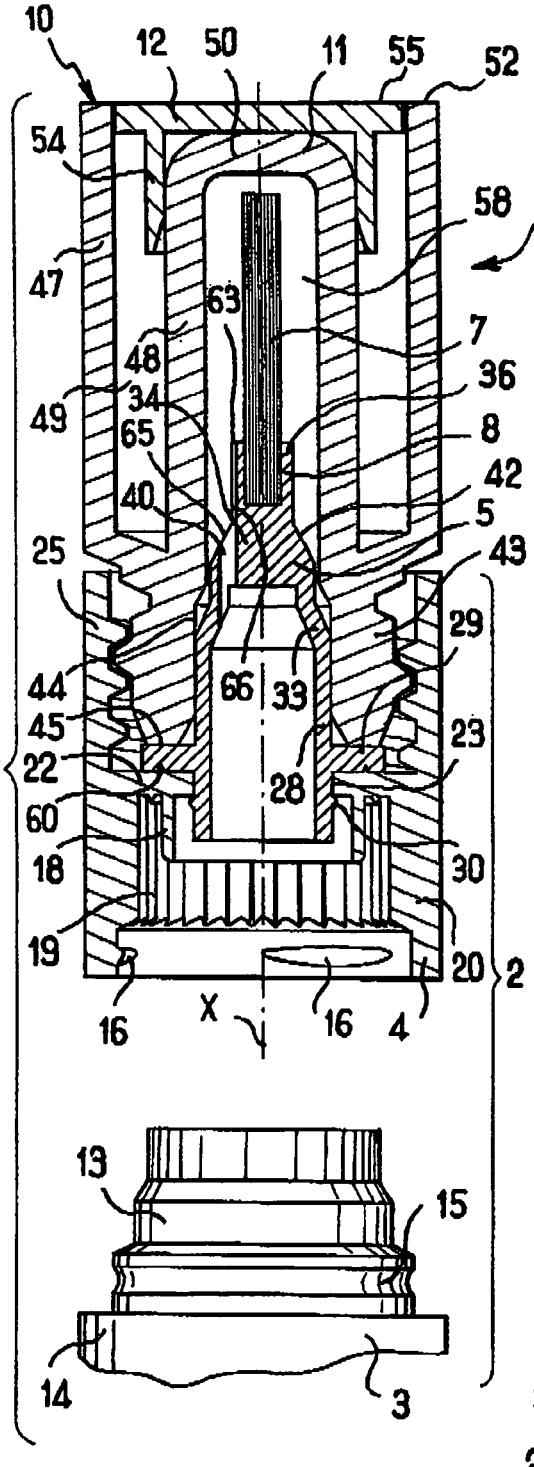

FIG. 1 depicts an exemplary embodiment of an device 1 configured to apply a product. The device 1 may include a receptacle 2 including a receptacle body 3, an adaptor 4 associated with (e.g., mounted onto) the receptacle body 3, and an applicator element holder 5 associated with (e.g., mounted onto) the adaptor 4. An applicator element 7 may be mounted in a housing 8 of the applicator element holder 5. The receptacle 2 may be closed in a substantially sealed manner by a closure cap 10, which may include, for example, a cap body 11 and a plug 12 mounted (e.g., fitted) thereon. For example, the applicator element 7 may be a bundle of bristles, with substantially all of the bristles being of about the same type or different types, straight and/or undulating, and may be disposed in such a manner so as to constitute, for example, a brush for applying a substance (product) onto the nails. For example, the applicator element 7 may define a convex outside surface. The invention is not limited to a particular applicator element 7, and applicator elements of any type and/or shape may be used, such as, for example, applicator elements comprising flocked tips, foam elements, felt elements, brushes, and/or flexible points.

Referring to FIG. 1, the receptacle body 3 (partially shown) may define a generally elongate shape along a longitudinal axis X of the applicator 1. For example, the receptacle body 3 may be formed with a neck 13 and a wall 14. For example, the wall 14 may be flexible and may be formed via extrusion and/or blow-molding, and the wall 14 may have shape memory such that the user is able to exert pressure on the wall 14, so as to reduce the receptacle 2's inside volume and force a portion of the substance contained therein to be dispensed onto the applicator element 7. The invention is not limited to forming the receptacle body 3 via extrusion and/or blow-molding, and the receptacle body 3 may be formed via other techniques such as, for example, injection molding one or more thermoplastic and/or thermosetting material, glass, ceramic, and/or metals.

According to an exemplary aspect, the substance contained in the receptacle body 3 may be a nail varnish, although it is not beyond the ambit of the present invention for the substance to be some other product, for example, a nail varnish remover, or more generally, any cosmetic product and/or care product, or even a non-cosmetic substance (e.g., paint for touching-up the bodywork of a motor vehicle). In an exemplary aspect, the substance is a liquid substance.

According to some embodiments, the receptacle body 3 may contain a ball configured to homogenize the substance contained in the receptacle body 3, for example, via shaking the receptacle.

In the exemplary embodiment depicted in FIG. 1, the adaptor 4 may be mounted, for example, to the receptacle body 3 via snap-fastening onto the neck 13. The neck 13 may include an annular groove 15 into which portions in relief 16 of the adaptor 4 may be snap-fastened. The portions in relief 16 may be carried by a mounting skirt 20 that may be substantially tubular about an axis X. According to some embodiments, the mounting skirt 20 may be discontinuous and may include fastening tabs for fastening the adaptor 4 onto the receptacle body 3.

The adaptor 4 may further include a lip 18 (e.g., an annular sealing lip) configured to bear against an inside surface of the neck 13. The adaptor 4 may include splines 19 configured to press tightly against the neck 13. The splines 19 may be formed on the mounting skirt 20 and may serve to prevent the adaptor 4 from turning relative to the neck 13, for example, while the cap 10 is being removed (e.g., via rotation).

According to some embodiments, a transverse wall 22 extending perpendicularly to the axis X, may be connected to the skirt 20, and/or may support the lip 18. The transverse wall 22 may define an opening 23.

The adaptor 4 may include a skirt 25 (e.g., a reception skirt), which may be internally threaded, such as shown in the embodiment depicted in FIG. 1, for receiving the cap 10, such that the cap 10 may be placed in threaded engagement with the skirt 25. The skirt 25 may extend substantially in line with the skirt 20 above the transverse wall 22.

The applicator element holder 5 may include a tubular portion 28, which passes through the opening 23 and carries a collar 29, which bears axially on the top face of the transverse wall 22. The tubular portion 28 may include an annular bead 30, which is, for example, snap-fastened below the transverse wall 22, so as to retain the applicator element holder 5 on the adaptor 4. The outside diameter of the tubular portion 28 may correspond substantially to the diameter of the opening 23.

The transverse wall 22 may include a relatively small lip 60 (e.g., an annular lip) so as to improve the sealing between the applicator element holder 5 and the adaptor 4, for example, when in the closed position.

As depicted in FIG. 1, the tubular portion 28 may be connected via a frustoconical portion 33 to a portion 34 (e.g., a solid top portion), which defines the end wall of the housing 8, which receives the applicator element 7. The portion 34 may be extended via a skirt 36, which defines a side wall of the housing 8 and/or which partially covers the applicator element 7. The inside section of the housing 8 may be circular about the axis X.

A channel 40 (e.g., a feed channel for feeding the applicator element 7 with substance) may pass through the portion 34. For example, the channel 40 may extend substantially parallel to the axis X, thereby rendering it relatively easy to form via molding, and the channel 40 may open out inside the applicator element holder 5, for example, substantially at the top of the frustoconical portion 33. The channel 40 may then pass through the portion 34 and continue along the skirt 36, for example, such that the channel 40 is outwardly open in a radial direction over its portion 66 extending along the skirt 36 to exit 63. The portion 34 may be outwardly defined by a frustoconical surface 42 in which the channel 40 may open out via an orifice 65 prior to extending along the length of the skirt 36. The cross section of the orifice 65 may be selected based on, for example, the viscosity of the substance contained in the receptacle 2, so that, among other things, the flow of substance is not too great when the receptacle 2 is inverted. The channel 40 may also enable air to be drawn into the receptacle 2, for example, when the receptacle body 3 returns to its initial shape (e.g., when the receptacle body 3 is elastically deformable).

As depicted in FIG. 1, the tubular portion 28 may include an inside cross-section that is significantly greater than the inside cross-section of the orifice 65, thereby possibly ensuring that any headloss suffered by the substance is relatively small, with the headloss essentially being caused while the substance passes through the portion 34.

According to some embodiments, such as the embodiment depicted in FIG. 1, the cap body 11 may include an externally threaded neck 43, which may be placed in threaded engagement with the skirt 25. Once the cap 10 has been tightened via the threading, it may bear via a radially inside surface 44 against the tubular portion 28, and via an end edge 45 against the collar 29. This may render it possible for the receptacle 2 to be closed in a substantially leak-tight manner.

The neck 43 may be extended via an outer skirt 47, for example, with the outer skirt 47 being circularly cylindrical about the axis X. The neck 43 may also be extended via an inner skirt 48, with the outer and inner skirts 47 and 48 together defining an annular space 49. One end of the inner skirt 48 may be closed via a top wall 50, which may be recessed relative to an end 52 of the outer skirt 47. A plug 12 may include a skirt 54 that may be force-fitted onto the inner skirt 48 (e.g., in the annular space 49). The plug 12 may rest against the top wall 50, and an outside face 55 of the plug 12 may be substantially flush with the top end 52 of the outer skirt 47. Together with the top wall 50, the inner skirt 48 may define a housing 58 into which the applicator element 7 may extend. The housing 58 may define a height that is sufficient to substantially ensure that an end (e.g., a top end) of the applicator element 7 is recessed with respect to the top wall 50, as shown in FIG. 1.

The volume of the housing 58 may be relatively small (e.g., less than one-fifth of the volume of the receptacle 3 (e.g., the volume of the housing 58 may be less than about 1 cubic centimeter, and volume of the receptacle 2 may be greater than about 5 cubic centimeters. This may serve to reduce the risk of the substance drying out on the applicator element 7 when the cap 11 is placed in the closed position on the receptacle 3.

According to some embodiments, the cap body 11 may be formed from one of a transparent material and a translucent material (e.g., a transparent plastic material), and the plug 12 may include a disk indicating the color of the substance in the receptacle. For example, the disk may include a deposit of the substance contained in the receptacle 2.

According to some embodiments, the applicator 1 may be assembled by inverting the cap 10. The applicator element holder 5 onto which the applicator element 7 may already have been mounted, may be inserted into the housing 58, for example, such that the collar 29 bears against the edge 45 of the neck 43 of the cap 10. The adaptor 4 may then be threaded onto the neck 43, thereby pushing the annular bead 30 through the opening 23 in the transverse wall 22 and past the transverse wall 22. Once the adaptor 4 has been tightened, this assembly may be uprighted and fixed via, for example, snap-fastening, onto the receptacle body 3, which may have already been filled with the substance to be applied.

In order to use some exemplary embodiments of the applicator 1, the user unscrews the cap 10 and can invert the receptacle 2 so as to point the applicator element 7 downward (e.g., at an angle of about 45° with respect to vertical). If desired, the user may exert pressure on the wall 14 of the receptacle body 3 so as to force the substance to flow through the channel 40. The substance that is expelled through the orifice 65 may flow via gravity along the portion 66 of the channel 40 extending along the skirt 36 so as to reach the periphery of the applicator element 7. In this way, the channel 40 may guide the substance out of the channel 40 and toward and over the outer periphery of the applicator element 7. If desired and/or if the receptacle 2 is suitably oriented, the user can visually check the quantity of substance being dispensed through the orifice 65, for example, so as to prevent the applicator element 7 from being loaded with too much substance.

Figure 2:
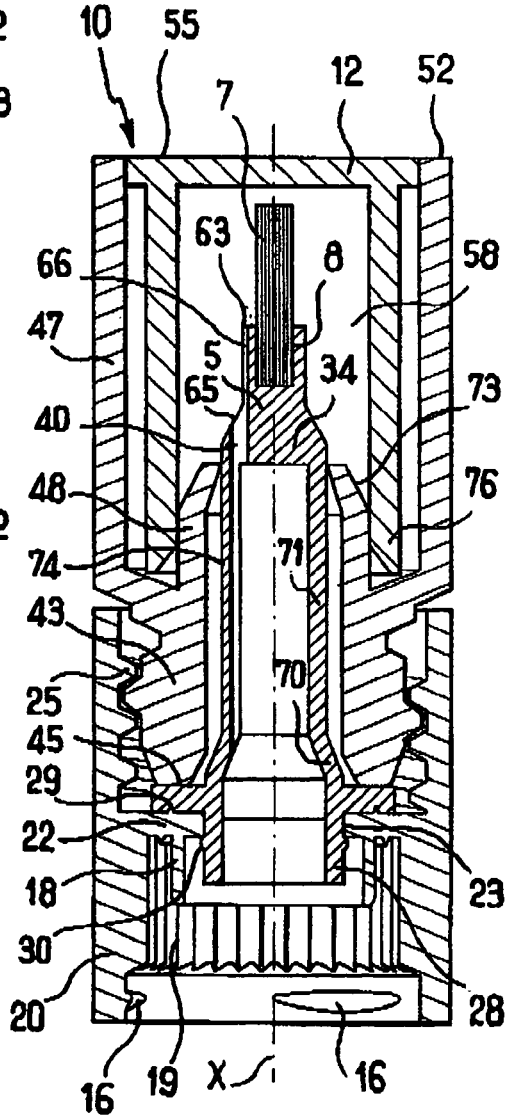
FIG. 2 is a schematic, partial section view of another embodiment of a device configured to apply a product.

FIG. 2 depicts an embodiment of applicator 1 that may include an exemplary applicator element holder 5 and/or an exemplary cap 10 that may have an alternative shape to those shown in FIG. 1. For example, the applicator element holder 5 may include a tubular portion 28 having a portion extending below the collar 29 and a portion above the collar 29 that includes a frustoconical portion 70 and a cylindrical portion 71 that may be connected to the portion 34. The cylindrical portion 71 may define a height that is greater than the height of the skirt 25, for example, so that the applicator element holder 5 projects substantially beyond the adaptor 4, which may sometimes render application easier.

In the exemplary embodiment depicted in FIG. 2, the cap 10 may include an outer skirt 47 that is substantially similar to (e.g., identical to) the skirt 47 depicted in FIG. 1, but the inner skirt 48 may include, in an upper portion, an elastically deformable annular lip 73, which bears against the outside surface 74 of the cylindrical portion 71, for example, substantially where it connects to the portion 34. The lip 73 may be configured to wipe the applicator element holder 5 as the cap 10 is removed, thereby reducing the risk of soiling. Furthermore, by bearing in a substantially sealed manner on the applicator element holder 5, the lip 73 may serve to reduce the volume of the housing 58 and may reduce the risk of the substance flowing down to the collar 29.

The exemplary embodiment depicted in FIG. 2 may include a plug 12 that may substantially seal the receptacle 2 when closed. For example, the plug 12 may include a skirt 76, which may engage in a substantially sealed manner with the inner skirt 48.

Figure 3:
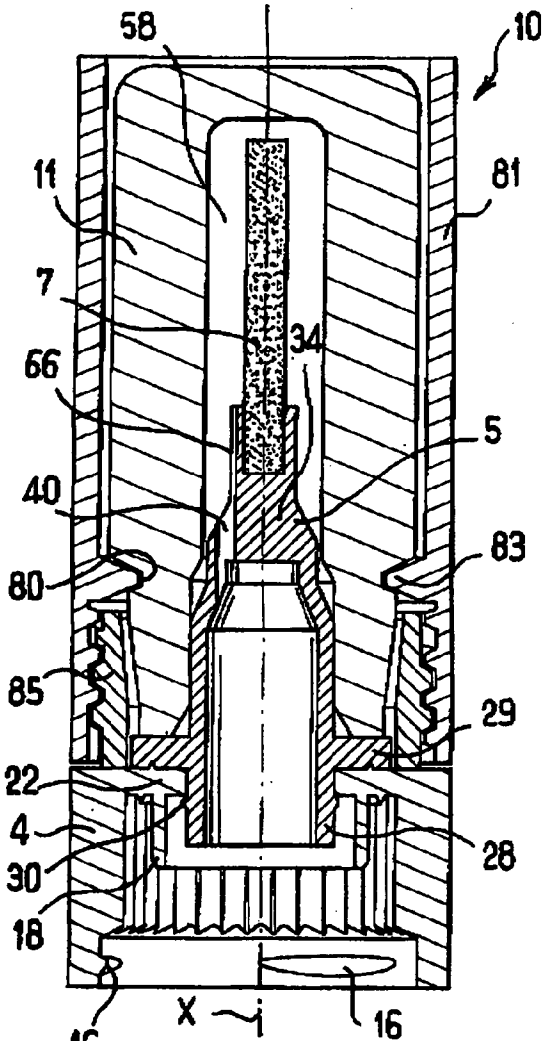
FIG. 3 is a schematic, partial section view of a further embodiment of a device configured to apply a product.

In the exemplary embodiment depicted in FIG. 3, the adaptor 4 and the cap 10 may have an alternative shape, and the applicator element 7 may comprise a flocked tip. For example, the cap 10 may include a body 11 that may be formed of glass and/or a glass-like substance, and the body 11 may be closed at an upper portion thereof and may include an annular groove 80 at a lower portion thereof. The cap 10 may also include a skirt 81 (e.g., a tubular outer skirt). The skirt 81 may include a bulge 83 that may be snap-fastened into the annular groove 80 and may be internally threaded for being placed in threaded engagement with an externally threaded skirt 85 of the adaptor 4. The skirt 85 may replace, for example, the internally threaded skirt 25 included in the exemplary embodiments shown in FIGS. 1 and 2. The body 11 may include a lower portion, for example, which bears in a substantially sealed manner against the tubular portion 28 above the collar 29.

Figure 4:
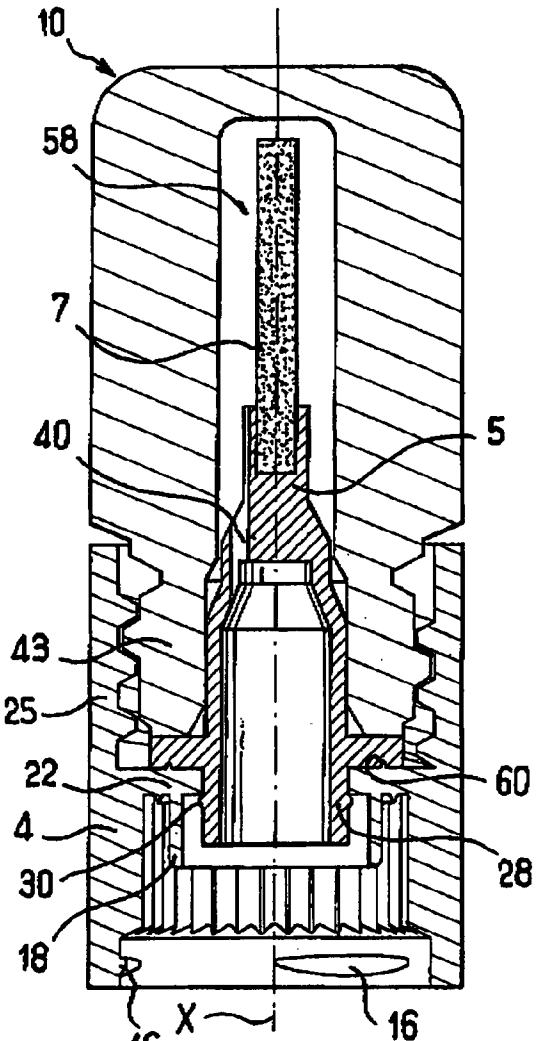
FIG. 4 is a schematic, partial section view of another embodiment of a device configured to apply a product.

The exemplary embodiment depicted in FIG. 4 may include a cap 10 having yet another alternative shape. For example, in the exemplary embodiment depicted in FIG. 4, the cap 10 may be monolithic (e.g., it may be formed as a single piece of either a transparent or a translucent material (e.g., a plastic material or of glass)). The cap 10 may include a neck 43 configured to be placed in threaded engagement with the internally threaded skirt 25 of the adaptor 4, and the neck 43 may be configured to bear in a substantially sealed manner against the tubular portion 28.

Figure 5:
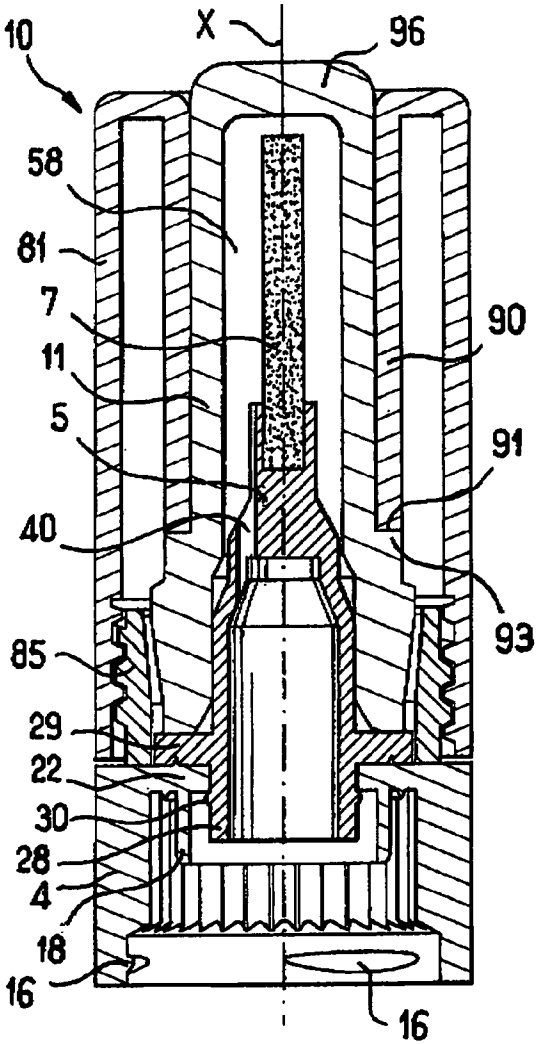
FIG. 5 is a schematic, partial section view of a further embodiment of a device configured to apply a product.

In the exemplary embodiment depicted in FIG. 5, the adaptor 4 includes an outer skirt 81 having an upper portion that is connected to an inner skirt 90 having a bottom end 91 that may be situated axially above a threaded portion engaged on the skirt 85. For example, the exemplary embodiment depicted in FIG. 5 may not include a portion in relief 83 (e.g., as shown in FIG. 3). The cap body 11 may be engaged in the inner skirt 90 and may define a shoulder 93, which abuts against the bottom end 91 of the skirt 90. The body 11 may bear, for example, via its bottom edge, against the collar 29, and may also bear against the tubular portion 28. For example, the body 11 may be formed from a material that may be either transparent or translucent, and the outer skirt 81 may be formed from a material that is substantially opaque. The top portion 96 of the cap body 11 may act as a window, for example, rendering it possible to see the applicator element 7 and/or, where appropriate, to observe the color of the substance in the applicator 1, for example, when a portion of the substance is present on the inside surface of the body 11.

Figure 6:
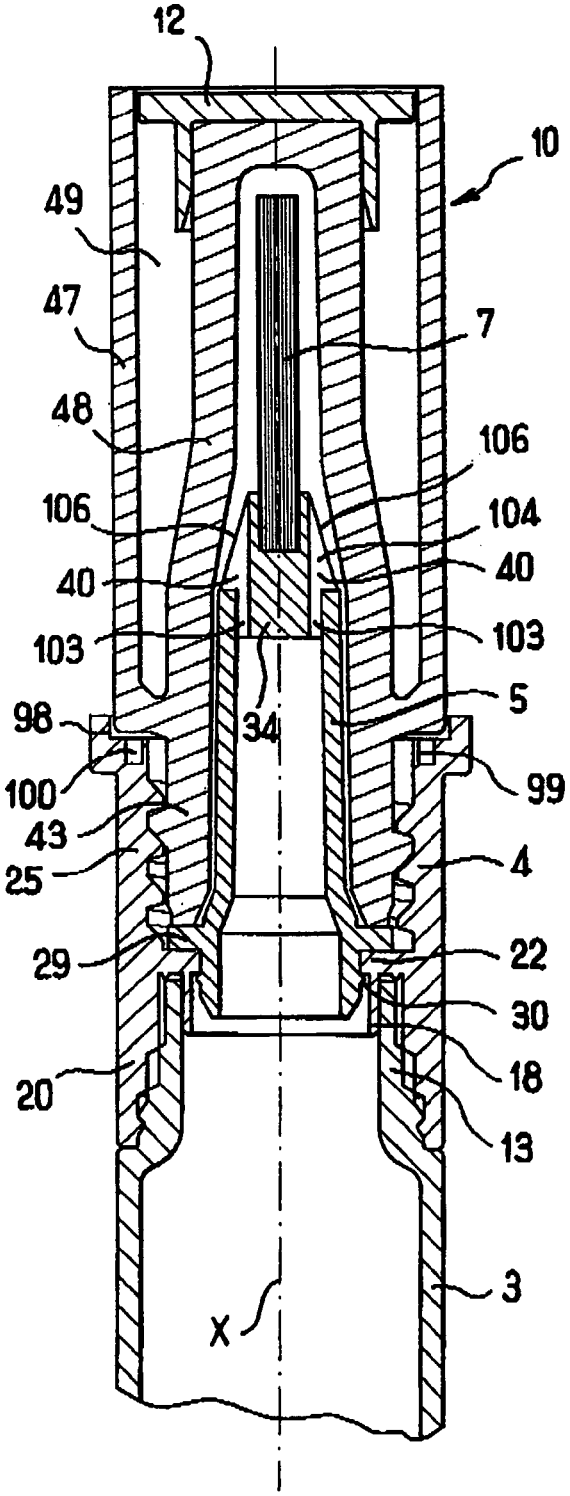
FIG. 6 is a schematic, partial section view of another embodiment of a device configured to apply a product.

The exemplary embodiment depicted in FIG. 6 may include a cap 10 having a structure at least somewhat similar to the structure of the cap 10 shown in the exemplary embodiment depicted in FIG. 1. For example, the adaptor 4 may include mounting and reception skirts 20 and 25, respectively, for mounting and receiving the cap 10. The skirt 25 may be extended at its upper portion by a rim 98 having an inside diameter that is slightly greater than the outside diameter of the skirt 47. The adaptor 4 may also include an annular lip 99 which, together with the rim 98, may serve to form an annular groove 100, for example, for the purpose of making the adaptor 4 more ergonomic, more attractive, and/or easier to remove from the mold (i.e., when the adaptor is formed via molding).

Figure 7:
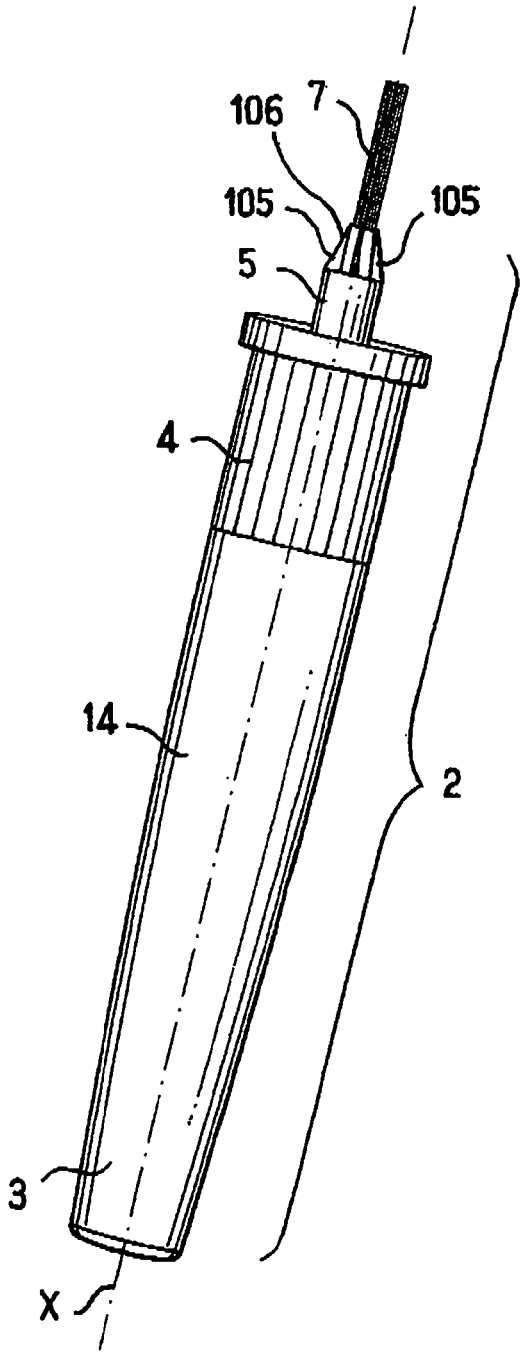
FIG. 7 is a schematic perspective view of the embodiment of FIG. 6 in one configuration.

The exemplary applicator 1 depicted in FIG. 6 includes a plurality of channels 40 configured to load the applicator element 7 with substance. For example, the channels 40 may include portions 103 that pass through the portion 34 and/or that open out into spaces 104 formed between tabs 105. The tabs 105 may define, for example, respective outside surfaces 106 that may extend obliquely toward the applicator element 7, as depicted in the exemplary embodiment shown in FIG. 7. The number of tabs 105 may range, for example, from about 2 to about 8.

Figure 8:
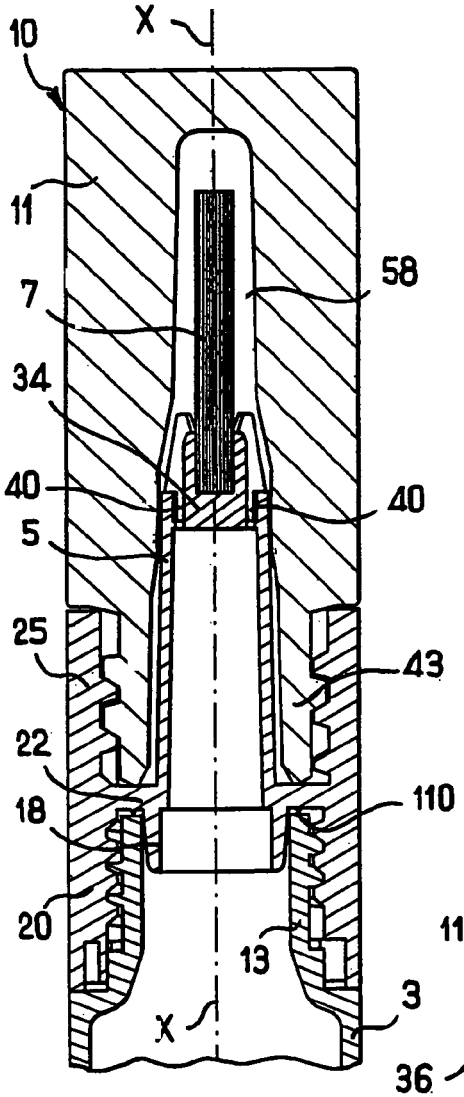
FIG. 8 is a schematic, partial section view of another embodiment of a device configured to apply a product.

The exemplary embodiment depicted in FIG. 8 includes an adaptor 4 that may have a mounting skirt 20 configured to be threaded onto the neck 13 of the receptacle body 3. The transverse wall 22 may include a small annular lip 110 configured to bear against the top edge of the neck 13. The skirt 25 of the adaptor 4 may be similar to the skirt 25 shown in FIG. 1. The cap 10 may include a one-piece body 11 having a neck 43 that defines an outside thread configured to be placed in threaded engagement with the skirt 25.

Figure 9:
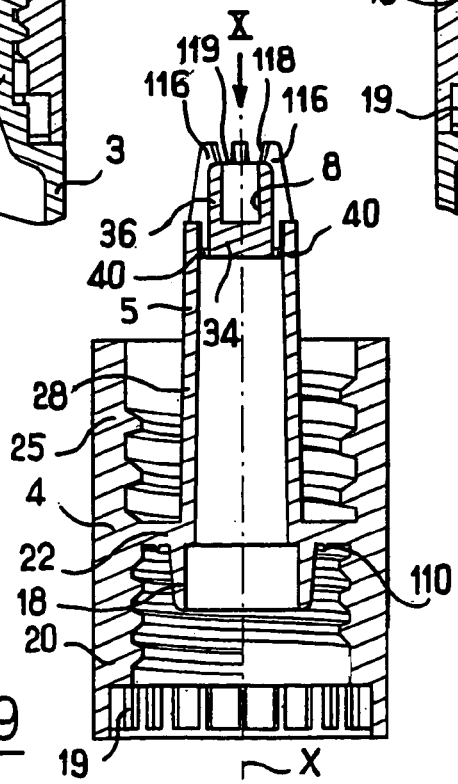
FIG. 9 is a schematic, partial section view of a further embodiment of a device configured to apply a product.
Figure 10:
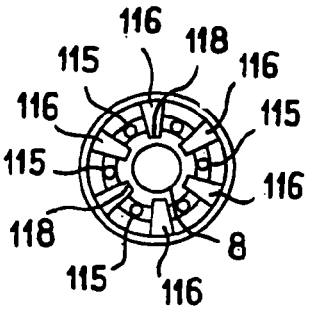
FIG. 10 is a schematic, partial view along line X of FIG. 9.

FIG. 9 depicts an exemplary embodiment in which the applicator element holder 5 may be integrally formed as a single piece with the adaptor 4. For example, the tubular portion 28 of the applicator element holder 5 may be connected to the transverse wall 22. The applicator element 7 may be fed via a plurality of channels 40, which may be evenly distributed angularly around the longitudinal axis X, and, for example, as shown in FIG. 10, the plurality of channels may open out via orifices 115 between tabs 116 that may extend along the length of the skirt 36 (e.g., around and/or slightly above the skirt). At their ends, the tabs 116 may define surfaces 118 that may slope downward and inward toward the mouth of the housing 8, for example, as depicted in FIG. 10. The surfaces 118 may render it easier for the substance to flow over the outside periphery of the applicator element 7 and/or may substantially prevent a drop of substance from forming, for example, when the applicator 1 is used in a inclined orientation.

Figure 11:
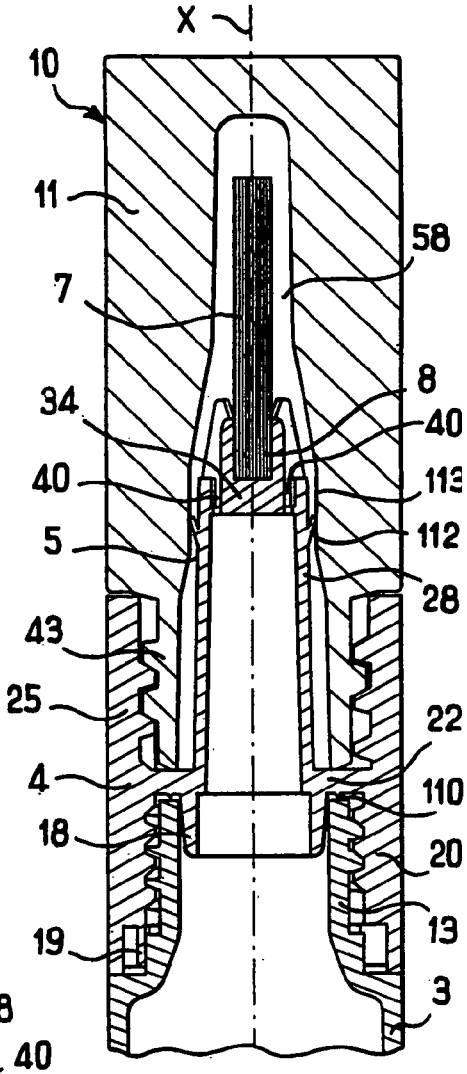
FIG. 11 is a schematic, partial section view of another embodiment of device configured to apply a product.

The exemplary embodiment shown in FIG. 11 includes an upwardly-radially diverging annular sealing lip 112 on the applicator element holder 5. The lip 112 may be arranged to bear against the cap 10, for example, at substantially the height of the base of the portion 34 when the cap 10 is mounted to the receptacle 2. The lip 112 may render it possible to limit the inside volume of the cap 10.

Figure 12:
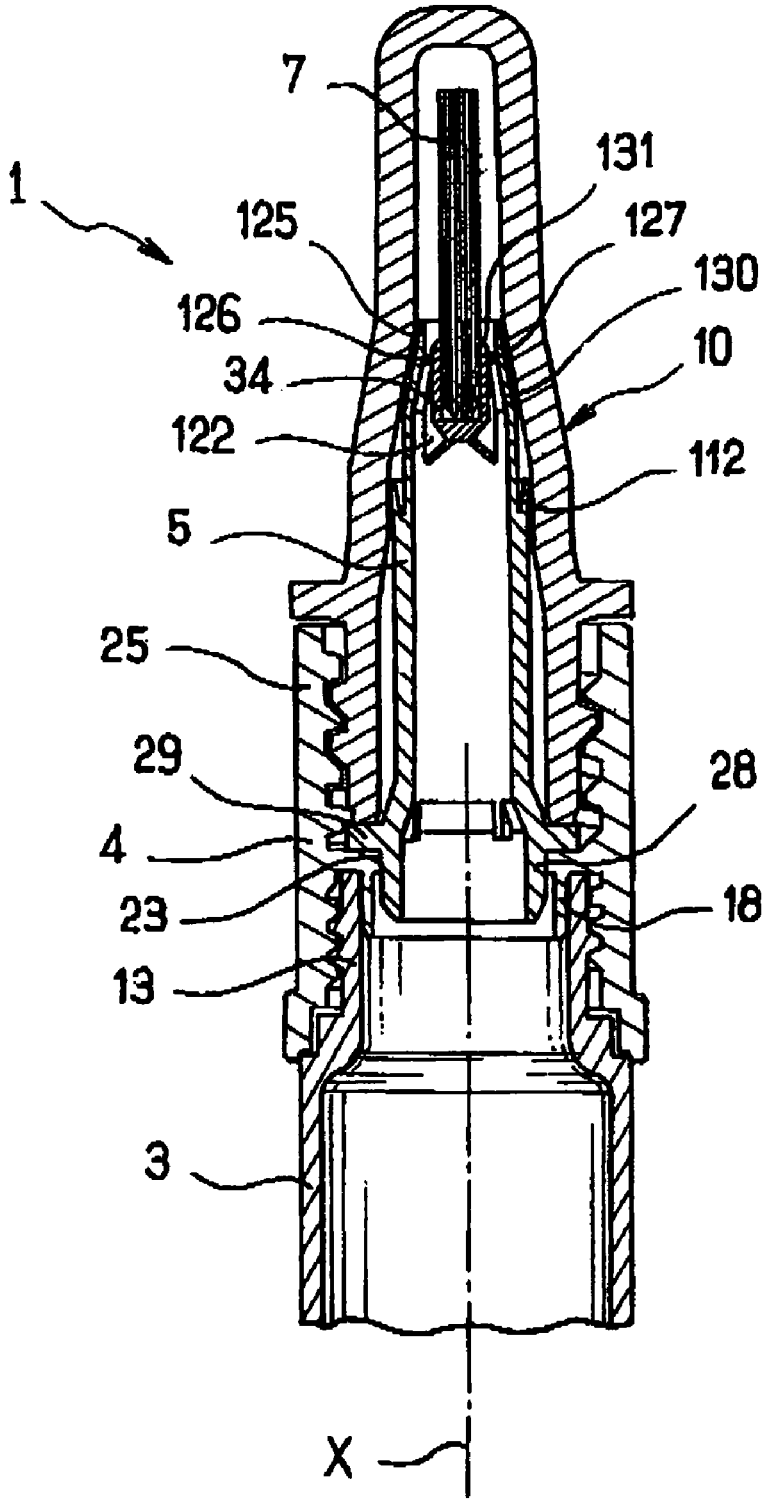
FIG. 12 is a schematic, partial section view of a further embodiment of device configured to apply a product.

According to some embodiments, the applicator element 7 may be received in a housing 8, which may be defined by a portion 34 formed monolithically, for example, via molding, with the applicator element holder 5 (e.g., as shown in the embodiment depicted in FIG. 1), and/or the housing 8 may be defined by an added part (e.g., as shown in the embodiment depicted in FIG. 12). For example, the applicator element holder 5 shown in FIG. 12 may include internal ribs 122 configured to mount the portion 34 in the applicator element holder 5. The portion 34 may be mounted to the applicator element holder 5 via force-fitting, snap-fastening, and/or another mounting arrangement. According to some embodiments, for example, as shown in FIG. 12, a tubular wall 125 may extend along a portion of the length of the applicator element 7 at an end of the applicator element holder 5.

In the embodiment depicted in FIG. 12, the loading of the applicator element 7 with the substance may be carried out through two channels 126 and 127 that may be diametrically opposed to one another relative to the axis X. The channels 126 and 127 may be formed between the portion 34 and the applicator element holder 5, for example, in the vicinity of the base of the tubular wall 125. The tubular wall 125 may render it possible, for example, to obtain a more homogeneous distribution of the substance around the applicator element 7. The channels 126 and 127 may open out in an annular space formed between the upper end 131 of the portion 34 and the tubular wall 125 and by the applicator element 7 and the tubular wall 125. The tubular wall 125 may connect at its base to a substantially truncated wall 130 of the applicator element holder 5, and the wall 130 may taper toward the distal end of the applicator element 7. Although the exemplary embodiment depicted in FIG. 12 includes two channels 126 and 127, the number of channels may be different and/or the device 1 may have, for example, more than two channels uniformly distributed around the axis X.

Aspects of the various embodiments described herein may be combined together within other embodiments. For example, the portion 34 may be formed with a different shape and, for example, with a hollow shape, the portion 34 may be configured to be about the same thickness as the skirt 36, for example, when the applicator element is fixed other than via stapling and/or when it is not necessary for the bottom of the housing 8 to be reinforced. The channel(s) 40 may be formed in still other configurations, such as, for example, so that they are not parallel to the axis X.

According to some embodiments, the bottom of the housing 8 may be configured to communicate with the inside of the receptacle 2 via a passage. Some embodiments may include a cap 10 configured to be fixed onto the applicator element holder 5, and the applicator element holder 5 may be configured to be fixed onto the receptacle body 3. Further, some embodiments may include a receptacle body 3 that is fitted with a pump or a valve, and the adaptor 5 may be connected thereto so as to be able to act on a rod of the pump or valve.

Sizes and shapes of various structural parts and materials used to make the above-mentioned parts are illustrative and exemplary only, and one of ordinary skill in the art would recognize that these sizes, shapes, and materials can be changed to produce different effects or desired characteristics.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device configured to apply a product, the device comprising:

a receptacle defining an inside space configured to contain a product to be applied, the inside space defining a volume and the receptacle comprising an applicator element holder;

an applicator element extending along a longitudinal axis and fixed in a first housing of the applicator element holder at least while the applicator element is in use, the applicator element comprising a bundle of bristles defining a convexly shaped outer periphery exterior to the first housing;

a cap configured to close the receptacle, the cap defining a second housing configured to receive the applicator element, the second housing defining a volume smaller than the volume of the inside space of the receptacle configured to contain the product to be applied; and at least one channel formed in the applicator element holder and outwardly opening through an orifice, said at least one channel configured to enable the product to flow from the receptacle through the orifice to reach the outside of the applicator element so that a first contact between the applicator element and the product coming out of said receptacle occurs exclusively on the outer periphery of said applicator element, wherein said at least one channel allows flow communication between an inside space of the cap and the inside space of the receptacle when the receptacle is closed by the cap, and wherein the at least one channel is disposed so as to be able to guide product from the receptacle toward and over the outer periphery of the outside of the applicator element.

2. The device of claim 1, wherein the receptacle comprises the at least one channel.

3. The device of claim 1, wherein the at least one channel is configured to guide product from the receptacle into the housing of the cap so that the housing can be at least partially filled with product when the receptacle is closed by the cap.

4. The device of claim 3, wherein the at least one channel is configured to permit the product to flow via gravity into the housing of the cap.

5. The device of claim 1, wherein the at least one channel comprises a plurality of channels configured to feed the applicator element.

6. The device of claim 5, wherein the plurality of channels are evenly distributed angularly around a longitudinal axis of the device.

7. The device of claim 1, wherein flow communication with the inside space of the receptacle and the housing of the cap occurs exclusively via the at least one channel.

8. The device of claim 1, wherein the receptacle defines a length at least twice as long as a length defined by the cap.

9. The device of claim 1, wherein the receptacle comprises a receptacle body and an adaptor mounted to the receptacle body, the adaptor being configured to permit the cap to be removably mounted to the receptacle.

10. The device of claim 9, wherein the applicator element holder is fitted onto the adaptor.

11. The device of claim 9, wherein the adaptor is configured to be threaded onto the receptacle body.

12. The device of claim 9, wherein the adaptor is configured to be mounted to the receptacle body via snap-fastening.

13. The device of claim 9, wherein the receptacle body comprises a neck and the adaptor comprises an annular sealing lip configured to bear in a substantially sealed manner against the neck of the receptacle body.

14. The device of claim 13, wherein the cap is configured to be threaded onto the adaptor via an internally threaded skirt.

15. The device of claim 9, wherein the cap is configured to be threaded onto the adaptor.

16. The device of claim 1, wherein the receptacle comprises a receptacle body and an adaptor associated with the receptacle body, and wherein the applicator element holder is formed integrally as a single piece with the adaptor.

17. The device of claim 16, wherein the adaptor and applicator element holder comprise a molded plastic material.

18. The device of claim 1, wherein the receptacle comprises a receptacle body and an adaptor mounted to the receptacle body, the adaptor being configured to permit the cap to be removably mounted to the receptacle, and wherein the cap bears in a substantially sealed manner against at least one of the applicator element holder and the adaptor.

19. The device of claim 1, wherein at least a portion of the cap is transparent.

20. The device of claim 1, wherein the cap comprises a body and a plug mounted to the body, the plug defining at least a portion of a top of the cap.

21. The device of claim 20, wherein the plug does not contribute in any way to closing the receptacle.

22. The device of claim 20, wherein the plug contributes to closing the receptacle.

23. The device of claim 22, wherein the body of the cap comprises a first skirt and the plug comprises a second skirt configured to bear in a substantially sealed manner against the first skirt.

24. The device of claim 1, wherein the cap is entirely transparent.

25. The device of claim 1, wherein the receptacle comprises an externally threaded skirt and the cap comprises an outer skirt and an inner skirt, the inner skirt being connected at one end to the outer skirt, wherein the outer skirt is configured to be placed in threaded engagement with the externally threaded skirt of the receptacle, and wherein the cap further comprises a body associated with the inner skirt, the body being configured to bear in a substantially sealed manner against the applicator element holder.

26. The device of claim 1, wherein the receptacle comprises an internally threaded skirt and the cap comprises an inner skirt and an outer skirt connected at one end to the inner skirt, the inner skirt being configured to be placed in threaded engagement with the internally threaded skirt of the receptacle.

27. The device of claim 1, wherein the cap comprises a plurality of parts associated with one another.

28. The device of claim 1, wherein the cap comprises a single piece.

29. The device of claim 1, wherein the receptacle comprises a receptacle body and an adaptor mounted to the receptacle body, the adaptor comprising a transverse wall and being configured to permit the cap to be removably mounted to the receptacle, and wherein the applicator element holder comprises a collar configured to abut against the transverse wall of the adaptor.

30. The device of claim 29, wherein the cap bears against the collar once tightened onto the adaptor.

31. The device of claim 29, wherein the applicator element holder comprises at least one portion defining one of an annular bead and an annular recess configured to be snap-fastened onto the transverse wall.

32. The device of claim 29, wherein the transverse wall comprises an annular lip.

33. The device of claim 1, wherein the cap comprises a sealing surface configured to bear against the applicator element holder.

34. The device of claim 33, wherein the sealing surface comprises a lip.

35. The device of claim 33, wherein the sealing surface is substantially conical.

36. The device of claim 1, wherein the applicator element holder comprises an annular sealing lip configured to bear against the cap when the cap is mounted to the device.

37. The device of claim 1, wherein the applicator element holder comprises a skirt partially covering the applicator element.

38. The device of claim 37, wherein the at least one channel extends over an outside surface of the skirt.

39. The device of claim 1, wherein the at least one channel comprises a plurality of channels and wherein the applicator element holder comprises at least two tabs such that the plurality of channels extend therebetween.

40. The device of claim 39, wherein the applicator element holder comprises at least three tabs and the plurality of channels extend therebetween.

41. The device of claim 39, wherein the tabs define outside faces sloping obliquely toward the applicator element.

42. The device of claim 39, wherein the tabs define free ends having surfaces directed toward the applicator element.

43. The device of claim 1, wherein the applicator element holder comprises a housing configured to receive the applicator element, the housing of the applicator element holder comprising a side wall defining a thickness and an end wall defining a thickness greater than the thickness of the side wall.

44. The device of claim 1, wherein the applicator element comprises a brush.

45. The device of claim 44, wherein the applicator element holder comprises internal ribs configured to mount the portion to the applicator element holder.

46. The device of claim 1, wherein the receptacle comprises two channels positioned substantially opposite to one another.

47. The device of claim 1, wherein the applicator element holder comprises a portion configured to receive the applicator element, the portion being added to the applicator element holder.

48. The device of claim 1, wherein the receptacle comprises a tubular wall extending along at least part of the length of the applicator element, the tubular wall being configured to distribute product delivered by the at least one channel around the applicator element.

49. The device of claim 1, wherein the applicator element comprises an end connected to the receptacle and a free end and defines an axis intersecting the end connected to the receptacle and the free end, wherein the at least one channel extends in a non-perpendicular direction relative to the axis.

50. The device of claim 49, wherein the at least one channel extends in a direction substantially parallel to the axis defined by the applicator element.

51. The device of claim 1, wherein the applicator element comprises one of a flocked tip, a foam element, a felt element, bristles, and a flexible point.

52. The device of claim 1, further comprising a product contained in the inside space of the receptacle.

53. The device of claim 52, wherein the product is chosen from a cosmetic product and a care product.

54. The device of claim 53, wherein the product comprises nail varnish.

55. The device of claim 1, wherein the orifice is located such that a user may visually check the quantity of product being delivered to the applicator element.

56. The device of claim 1, wherein said at least one channel is unobstructed over its entire length.

57. The device of claim 1, wherein the at least one channel comprises a portion having a tubular cross section and a portion having an open-sided cross section.

58. A device configured to apply a product, the device comprising:

a receptacle defining an inside space configured to contain a product to be applied, the inside space defining a volume and the receptacle comprising an applicator element holder;

an applicator element fixed in a first housing of the applicator element holder at least while the applicator element is in use, the applicator element comprising a bundle of bristles defining a convexly shaped outer periphery exterior to the housing;

a cap configured to close the receptacle, the cap defining a second housing configured to receive the applicator element, the second housing defining a volume smaller than the volume of the inside space of the receptacle; and at least one channel formed in the applicator element holder and outwardly opening through an orifice, said at least one channel establishing the only fluid communication between the inside space and the outer periphery of the applicator element, wherein said at least one channel allows flow communication between an inside space of the cap and the inside space of the receptacle when the receptacle is closed by the cap, and wherein the at least one channel is disposed so as to be able to guide product from the receptacle toward and over the outer periphery of the outside of the applicator element.

59. The device of claim 58, wherein the applicator element comprises an end connected to the receptacle and a free end and defines an axis intersecting the end connected to the receptacle and the free end, and wherein the at least one channel extends in a direction substantially parallel to the axis defined by the applicator element.

60. The device of claim 58, wherein the at least one channel comprises a portion having a tubular cross section and a portion having an open-sided cross section.

61. The device of claim 58, wherein the at least one channel comprises a plurality of channels.

62. The device of claim 58, wherein the applicator element comprises one of a flocked tip, a foam element, a felt element, bristles, and a flexible point.

63. The device of claim 58, further comprising a product contained in the inside space of the receptacle.

64. The device of claim 63, wherein the product is chosen from a cosmetic product and a care product.

65. The device of claim 64, wherein the product comprises nail varnish.

66. The device of claim 58, wherein said at least one channel is unobstructed over its entire length.

67. A method of applying a product, the method comprising:

providing a device comprising a receptacle defining an inside space containing a product and comprising an applicator element holder, an applicator element comprising a bundle of bristles mounted in a first housing of the applicator element holder and defining a convexly shaped outer periphery exterior to the first housing, a channel being formed in the applicator element holder and opening out through an orifice, said channel enabling the product contained in said receptacle to flow from said receptacle through said orifice to reach the outer periphery of the applicator element without passing through the first housing so that a first contact between the applicator element and the product flowing from said receptacle is with the outer periphery of said applicator element, and a cap defining a second housing configured to receive the applicator element when the device is in a storage position, the second housing having a volume smaller than a volume of the inside space, wherein said channel allows flow communication between an inside space of the cap and the inside space of the receptacle when the receptacle is closed by the cap, and wherein the channel is disposed so as to be able to guide product from the receptacle toward and over the outer periphery of the outside of the applicator element;

removing the cap from the receptacle so as to expose the applicator element; and flowing product contained in the inside space through said channel.

68. The method of claim 67, wherein the applicator element has an end connected to the receptacle and a free end and defines an axis intersecting the end connected to the receptacle and the free end, and wherein flowing the product includes flowing the product through the at least one channel such that the product exits the channel in a non-perpendicular direction relative to the axis of the applicator element.

69. The method of claim 68, wherein flowing the product includes flowing the product through the at least one channel such that the product exits the channel in a substantially parallel direction relative to the axis of the applicator element.

70. The method of claim 67, wherein the product is chosen from a cosmetic product and a care product.

71. The method of claim 70, wherein the product comprises nail varnish.

72. The device of claim 67, wherein said channel is unobstructed over its entire length.

73. The method of claim 67, wherein the at least one channel comprises a portion having a tubular cross section and a portion having an open-sided cross section.

* * * * *